US009912104B2

(12) United States Patent
Barr

(10) Patent No.: US 9,912,104 B2
(45) Date of Patent: Mar. 6, 2018

(54) LIGHTNING ARRESTOR CONNECTOR WITH MESH DIELECTRIC STRUCTURE

(71) Applicant: Honeywell Federal Manufacturing & Technologies, LLC, Kansas City, MO (US)

(72) Inventor: Christian Barr, Kansas City, MO (US)

(73) Assignee: Honeywell Federal Maunfacturing and Technologies, LLC, Kansas City, MO (US)

( * ) Notice: Subject to any disclaimer, the term of this patent is extended or adjusted under 35 U.S.C. 154(b) by 0 days.

(21) Appl. No.: 15/490,325

(22) Filed: Apr. 18, 2017

(65) Prior Publication Data

US 2017/0222369 A1 Aug. 3, 2017

(51) Int. Cl.

| | |
|---|---|
| ***H01R 9/05*** | (2006.01) |
| ***H01R 13/655*** | (2006.01) |
| ***H01R 13/623*** | (2006.01) |
| ***H01T 4/08*** | (2006.01) |

(52) U.S. Cl.
CPC ..... *H01R 13/655* (2013.01); *H01R 13/623* (2013.01); *H01T 4/08* (2013.01)

(58) Field of Classification Search
CPC ..... H01T 4/08; H01R 13/623; H01R 13/655
USPC ..... 439/91, 63, 581, 675, 827
See application file for complete search history.

(56) References Cited

U.S. PATENT DOCUMENTS 4,039,238 A * 8/1977 Johnson, Jr. ..... H01R 13/187 439/843
4,340,923 A * 7/1982 Bazarian ..... H01T 4/06 361/120
4,365,282 A * 12/1982 Brainard ..... H01C 7/12 338/21
4,952,173 A * 8/1990 Peronnet ..... H01R 24/48 439/583
5,203,721 A * 4/1993 Buck ..... H01R 9/0509 439/581
5,683,255 A * 11/1997 Menze ..... H01R 13/646 439/63
5,755,596 A * 5/1998 Watson ..... H01R 13/025 174/267
6,146,168 A * 11/2000 Ishii ..... H01R 13/7031 439/188

(Continued)

FOREIGN PATENT DOCUMENTS

WO 2010128105 12/2012

OTHER PUBLICATIONS

A novel processing approach for free-standing porous non-oxide ceramic supports from polycarbosilane and polysilazane precursors; Journal of the European Ceramic Society; Sep. 2015; Konegger, Thomas.

*Primary Examiner* — Abdullah Riyami
*Assistant Examiner* — Nelson R Burgos-Guntin
(74) *Attorney, Agent, or Firm* — Hovey Williams LLP

(57) ABSTRACT

A dielectric barrier for use with a lightning arrestor connector comprises a plurality of physically connected cells defining a hollow, tubular side wall, with each cell including a frame formed from dielectric material and an aperture that creates a void within the frame. The dielectric barrier is configured to be positioned between an inner conductor and an outer conductor and provides a low resistance path from one conductor to the other conductor when the voltage between the two conductors exceeds a threshold value.

13 Claims, 4 Drawing Sheets

(56) References Cited

U.S. PATENT DOCUMENTS 6,514,895 B1 2/2003 Chiu et al.
6,568,964 B2 * 5/2003 D'Addario ..... H01R 13/17 439/675
6,830,459 B2 * 12/2004 West ..... H01R 4/302 174/138 G
6,939,175 B2 * 9/2005 Parrish ..... G01R 1/07378 439/620.03
6,945,795 B1 * 9/2005 Gross, III ..... H01R 23/6873 439/63
7,102,868 B2 9/2006 Montena
7,722,415 B2 * 5/2010 Chansrivong ..... H01R 13/15 439/788
7,896,666 B2 * 3/2011 Tung ..... H01R 13/4538 439/141
8,057,269 B2 * 11/2011 Ledermann ..... H01R 13/187 439/827
8,162,672 B2 * 4/2012 Huang ..... H01R 13/11 439/580
8,441,795 B2 * 5/2013 Jones ..... H01T 4/08 333/185
8,616,898 B2 * 12/2013 Lee ..... H01R 24/50 439/63
8,976,500 B2 * 3/2015 Penwell ..... H01R 24/48 307/90
9,190,837 B2 * 11/2015 Tollefsbol ..... H02H 9/005
9,401,571 B2 * 7/2016 Furukawa ..... H01R 13/46
2004/0014334 A1 * 1/2004 Lu ..... H01R 9/0506 439/63
2007/0097583 A1 5/2007 Harwath
2010/0190359 A1 * 7/2010 Suzuki ..... H01R 24/50 439/63
2010/0254067 A1 10/2010 Wei
2010/0261361 A1 * 10/2010 Kasparian ..... H01R 13/187 439/259
2012/0171884 A1 * 7/2012 Dang ..... H01R 13/6463 439/310
2013/0040481 A1 * 2/2013 Vallely ..... H01R 13/111 439/312
2014/0377989 A1 * 12/2014 Yang ..... H01R 9/05 439/581
2015/0004837 A1 * 1/2015 Brichard ..... H01R 24/30 439/607.41
2016/0064326 A1 3/2016 Zhang et al.
2017/0222369 A1 * 8/2017 Barr ..... H01R 13/6395

* cited by examiner

LIGHTNING ARRESTOR CONNECTOR WITH MESH DIELECTRIC STRUCTURE

BACKGROUND OF THE INVENTION

Field of the Invention

Embodiments of the current invention relate to lightning arrestor connectors.

Description of the Related Art

Electrical connectors generally transfer an electrical signal or electrical power between an electronic device and a cable. The electronic device may be embodied by TVs, video components, audio components, data communications and networking components, tablet, laptop, and desktop computers, mobile devices such as smartphones, navigation equipment, and the like. Typically, an electrical connector on the cable connects to an electrical connector on the electronic device to transfer a signal and/or power from the cable to the device or vice-versa.

Each electrical connector may include a shell or housing and one or more electrical contacts. The shell is often formed from electrically conductive material, such as metal, and has a hollow cylindrical or box shape. The shell may often have a mechanical coupler component, such as internal or external threads, lugs, latches, clamps, etc., in order for one connector to stay connected to another connector. The electrical contact may include a pin, a rod, or the like retained within the interior of the shell and may be separated from the shell by an insulator.

Occasionally, the devices, cables, or systems to which the electrical connectors are connected may be exposed to, or experience, a surge in electrical voltage, electrical current, or both as a result of lightning or other phenomena, wherein the voltage on the electrical contact may increase exponentially. Some electrical connectors include a lightning (or surge) arrestor structure in an effort to prevent the surge from being passed on to electronic circuits. When the voltage exceeds a certain threshold, the lightning arrestor structure should break down electrically and provide a low resistance path to electrical ground through which surge current flows.

The lightning arrestor structure typically comprises a web, one or more breakdown chambers, and one or more dielectric barrier. The web may include a disc or block of electrically conductive material oriented transverse to a longitudinal axis of the connector. The web may be mechanically coupled to the shell and electrically connected to electrical ground. The web may include one or more through-hole openings, each opening to receive one electrical contact of the electrical connector. Each breakdown chamber may be located in one of the openings of the web and may provide a gap between the electrical contact and the opening in which the contact is positioned. Each dielectric barrier may be formed from electrically polarizable insulating material and may be positioned in the breakdown chamber. In some implementations, the dielectric barrier may have a hollow tubular shape with a single circumferential wall having an inner surface facing the electrical contact and an outer surface facing the through-hole opening of the web. One drawback to these implementations is that the surge current may not penetrate the solid material of the dielectric barrier sidewall and instead may flow from the electrical contact to the web at one or the other of the ends of the sidewall. The result is that the lightning arrestor structure may not break down soon enough, potentially leading to electronic circuit damage.

In other implementations, the dielectric barrier may be formed from granular dielectric material such as granules of lead magnesium niobate/lead titanate (PMN/PT). The granules may resemble sand and are typically poured into the breakdown chamber while the electrical contact is positioned therein. The granules may provide lower resistance air gaps roughly uniformly distributed throughout the volume of the breakdown chamber which would allow surge current to flow from the electrical contact to the web at roughly any point along the axial length of the breakdown chamber. However, given the small gap between the electrical contact and the web in the breakdown chamber, filling the chamber with the granules and verifying that the chamber is filled are both difficult—resulting in a decrease of quality control and unpredictable performance of the lightning arrestor structure.

SUMMARY OF THE INVENTION

Embodiments of the current invention provide a distinct advance in the art of lightning arrestor connectors and solve the above-mentioned problems by providing a dielectric barrier for use with a lightning arrestor connector that allows for electrical breakdown along its length and that is easily and reliably installed into a breakdown chamber. More specifically, the dielectric barrier may comprise a plurality of physically connected cells defining a hollow, tubular side wall, with each cell including a frame formed from dielectric material and an aperture that creates a void within the frame. The dielectric barrier is configured to be positioned between an inner conductor and an outer conductor and provides a low resistance path from one conductor to the other conductor when the voltage between the two conductors exceeds a threshold value.

Embodiments of the current invention may also provide a lightning arrestor connector comprising a shell, a web, an electrical contact, and a dielectric barrier. The shell includes an internal cavity and opposing open ends. The web is formed from electrically conductive material and is positioned in the interior of the shell. The web includes a through-hole opening. The electrical contact is formed from electrically conductive material and is retained within the through-hole opening. The electrical contact has a smaller diameter than a diameter of the through-hole opening and forms a gap between the electrical contact and a surface of the through-hole opening which defines a breakdown chamber. The dielectric barrier is positioned in the breakdown chamber and is configured to provide a low resistance path between the electrical contact and the web when the voltage between the electrical contact and the web exceeds a threshold value. The dielectric barrier is constructed from a plurality of physically connected cells, with each cell including a frame formed from dielectric material and an aperture that creates a void within the frame.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
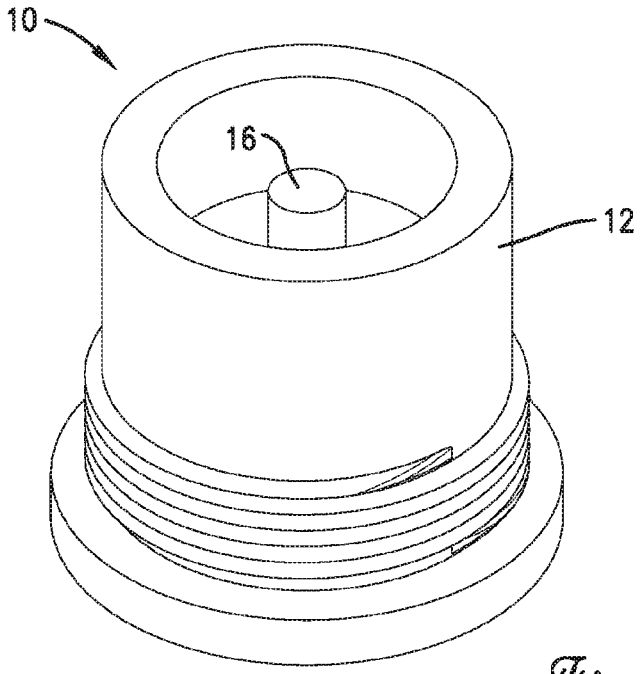
FIG. 1 is an upper perspective view of a lightning arrestor connector constructed in accordance with various embodiments of the current invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
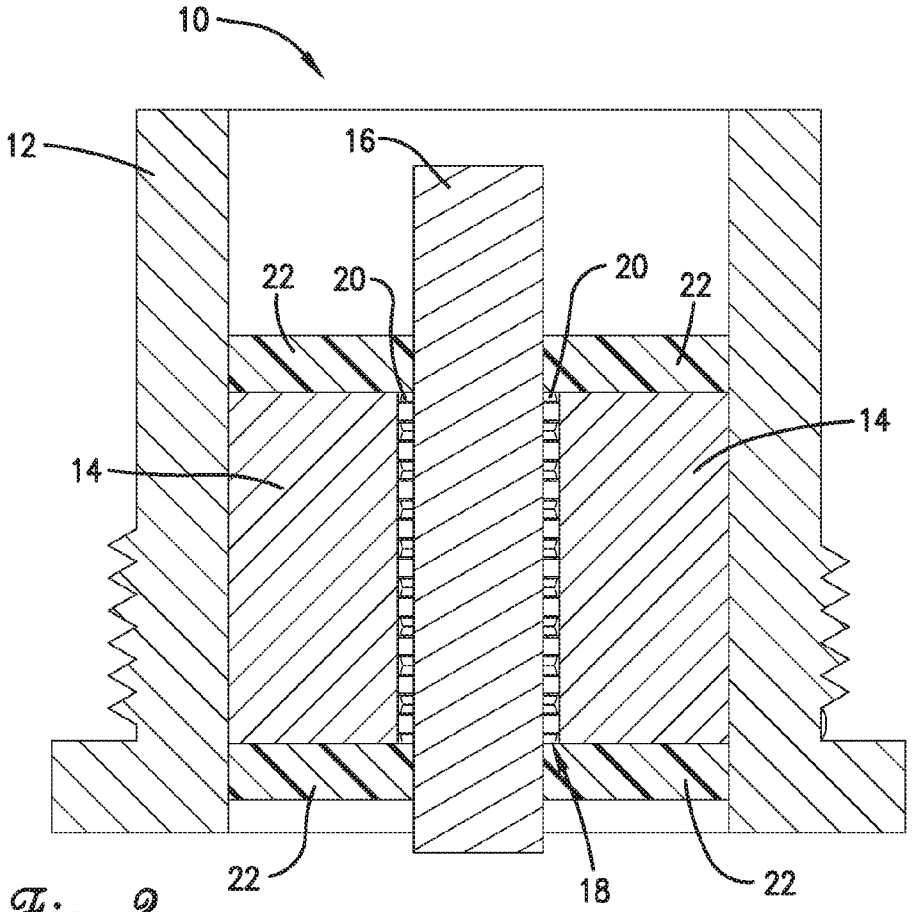
FIG. 2 is a cross-sectional view the lightning arrestor connector cut along a vertical plane.
Figure 3:
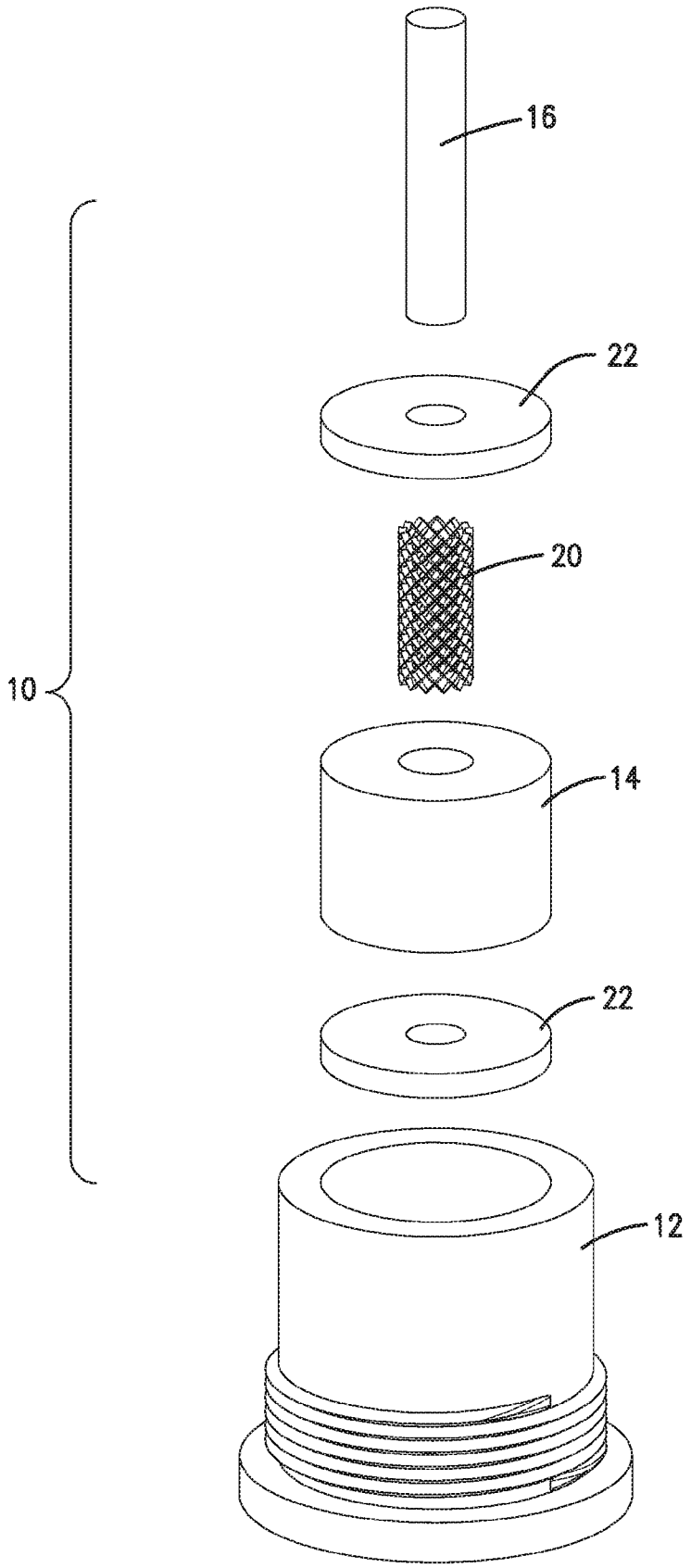
FIG. 3 is an exploded view of the lightning arrestor connector including a shell, a couple of insulators, a web, an electrical contact, and a dielectric barrier.

A lightning arrestor connector 10, constructed in accordance with various embodiments of the current invention, is shown in FIGS. 1-3. The lightning arrestor connector 10 may broadly comprise a shell 12, a web 14, one or more electrical contacts 16, one or more breakdown chambers 18, and one or more dielectric barriers 20.

The shell 12 may be formed from electrically conductive material including metals such as aluminum, nickel, copper, tin, and others, alloys such as bronze, brass, steel, and the like. In some embodiments, at least a portion of the shell 12 may be formed from rigid polymers, hardened rubber, or the like. The shell 12 may have an internal cavity and opposing open ends. Some embodiments of the shell 12 may have a hollow cylindrical shape with a single circumferential side wall, while other embodiments may have a hollow box shape with four side walls and two partial end walls. The shell 12 may also include at least one mechanical coupler component, such as internal or external threads, lugs, latches, clasps, etc., in order for one connector to stay connected to another connector. In some embodiments, the coupler component may be positioned at one or each end of the circumferential side wall of the shell 12. In other embodiments, the coupler component may be positioned on one or each end wall of the shell 12. The shell 12 may further include electrical insulators 22, such as polymers, in the form of rings, discs, blocks, gaskets, and the like, to provide structural support and/or electrical isolation.

The web 14 may be formed from electrically conductive material including metals such as silver, gold, aluminum, nickel, copper, and others, alloys such as bronze, brass, steel, and the like. The web 14 may have a disc or block shape and may be oriented transverse to a longitudinal axis of the lightning arrestor connector 10. The web 14 may be mechanically coupled to the shell 12 and may contact an inner surface thereof. The web 14 may include one or more through-hole openings, each opening configured to receive one electrical contact 16. Typically, the openings have a circular shape, but may also have an oval, a square, a rectangular, or other shape.

Each electrical contact 16 may be formed from electrically conductive material including metals such as silver, gold, aluminum, nickel, copper, and others, alloys such as bronze, brass, steel, and the like. The electrical contact 16 may be of a male type and may include a pin, a rod, or the like, or may be of a female type and may include a hollow sleeve or receptacle. The electrical contact 16 may have a generally circular, square, or rectangular cross-sectional shape. The electrical contact 16 may have a diameter, or lateral dimension, that is smaller than a diameter, or lateral dimension, of the through-hole opening. Each electrical contact 16 is positioned within one through-hole opening of the web 14 and may be held in place by the insulators 22. Given that the electrical contact 16 may be smaller than the opening in which it is held, there is a gap between the electrical contact 16 and a surface of the opening. The gap may also be known as a spark gap.

Each breakdown chamber 18 may be located in, or defined by, the spark gap between the electrical contact 16 and a surface of the opening.

Figure 4:
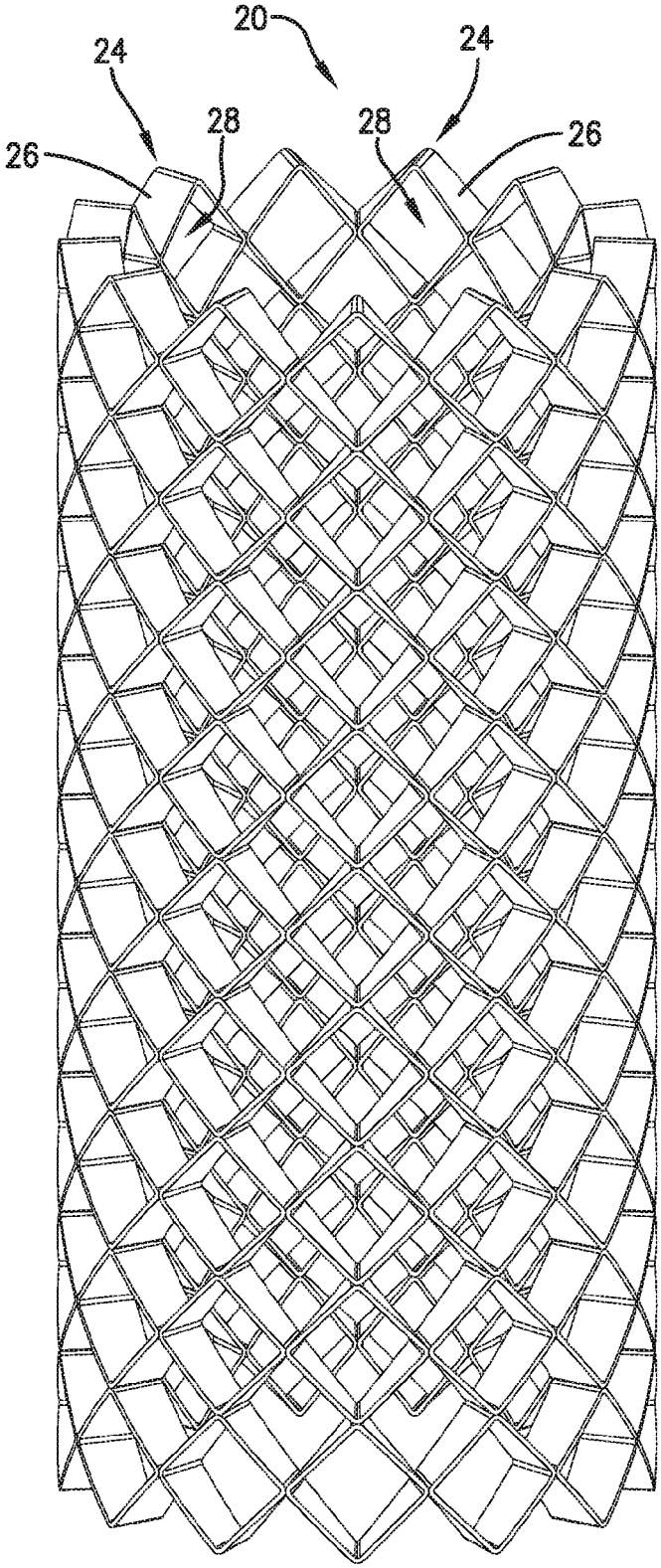
FIG. 4 is a perspective view of a first embodiment of the dielectric barrier.

Each dielectric barrier 20, shown in detail in FIG. 4, may be constructed from electrically polarizable insulating (dielectric) material and may be positioned in one breakdown chamber 18. The dielectric barrier 20 may act to artificially reduce the size or distance of the spark gap. The dielectric barrier is generally designed to provide electrical breakdown, i.e., a low resistance path, between the electrical contact 16 and the web 14 when the voltage between the two exceeds a threshold value. The dielectric barrier 20 may have a hollow tubular shape with a circumferential side wall or an open-ended hollow box shape with four side walls, depending on the shape of the electrical contact 16 and the breakdown chamber 18. A dielectric constant of the material of the dielectric barrier 20 and a thickness of the side wall(s) may both determine the threshold of the breakdown voltage.

Figure 5:
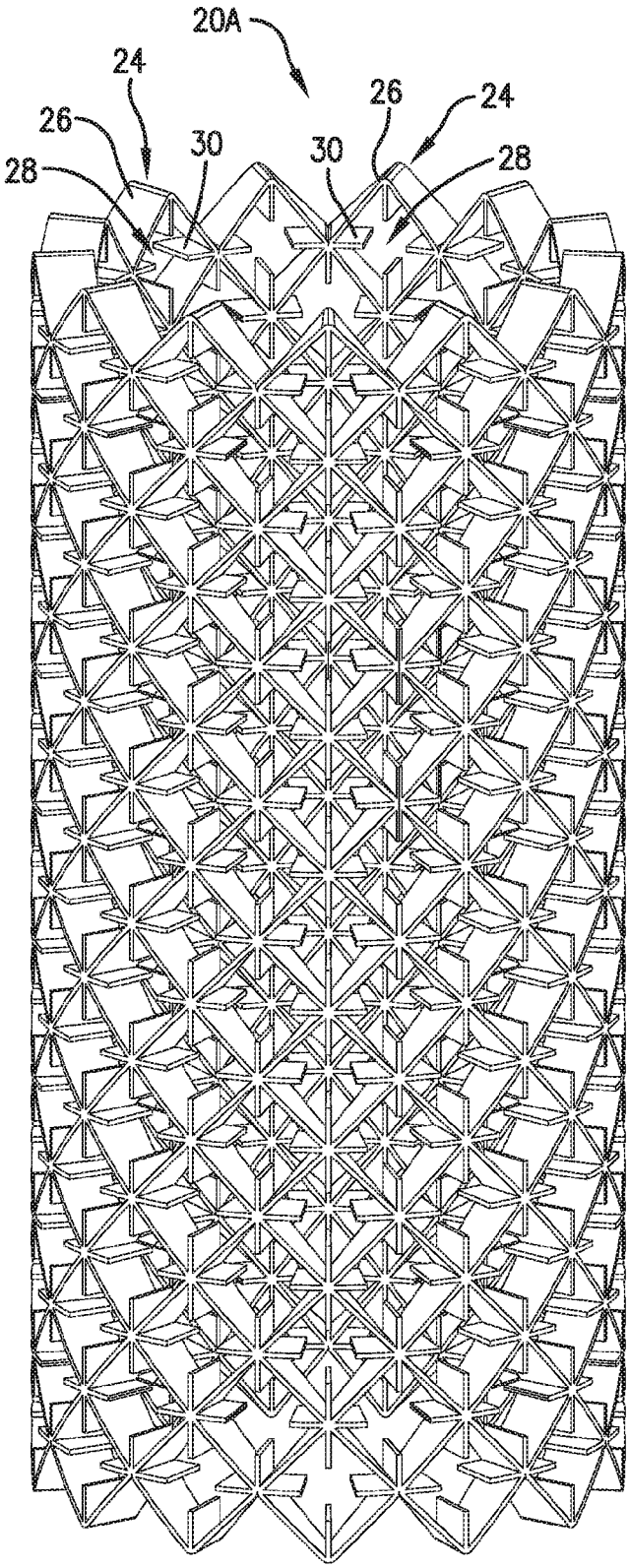
FIG. 5 is a perspective view of a second embodiment of the dielectric barrier.

The dielectric barrier 20 may be formed to include a plurality of physically connected cells 24 or struts. Each cell 24 may include a frame 26 formed from solid material and an aperture 28 that creates a void. The frame 26 may have nearly any geometric shape such as a circle, oval, triangle, square, diamond, rectangle, polygon, or the like. The aperture 28 may be positioned within the frame 26 and may have nearly any geometric such as a circle, oval, triangle, square, diamond, rectangle, polygon, or the like. The aperture 28 may be the same shape or a different shape as the frame 26. In an alternative embodiment of the dielectric barrier 20A shown in FIG. 5, each cell 24 may optionally include a plurality of posts 30, each of which connects to the frame 26 and extends into the aperture 28. Each post 30 may be generally elongated with a length greater than its thickness or width and may be formed from the same material as the frame 26. In some embodiments, the cells 24 that form the dielectric barrier 20 may all be the same in shape and size. In other embodiments, the cells 24 may have the same shape but may vary in size. In still other embodiments, the cells 24 may vary in shape, wherein the shape of the frame 26, the aperture 28, or both may vary from cell 24 to cell 24. The cells 24 may be connected to one another such that a portion of the frame 26 of one cell 24 may be physically connected to a portion of the frame 26 of another cell 24. In some embodiments, the connection of the cells 24 may form a lattice structure.

The dielectric barrier 20 may be constructed using additive manufacturing or 3-D printing techniques such as selective laser sintering that may be used with materials such as ceramics.

The lightning arrestor connector 10 may be configured to attach, couple, or connect to one end of a cable or a housing or chassis of an electronic device or a piece of electrical equipment. In such situations, the shell 12 may be physically connected to a sheath, in the case of the cable, or to a wall or bulkhead of the electronic housing. One end of the electrical contact 16 may be electrically connected to another electrical conductor such as a wire. In some situations, the web 14 may be electrically connected to electrical ground through the shell 12 being connected to the electronic housing that is grounded. In other situations, the web 14 may be electrically connected to electrical ground through an electrical conductor in the cable that is to be connected to electrical ground. In still other situations, the web 14 may be electrically connected to electrical ground through a terminal on the shell 12 to which an electrical ground wire is connected.

The lightning arrestor connector 10 may also be configured to mount on a printed circuit board, wherein one end of the electrical contact 16 may be electrically connected, such as with solder, to a trace on the board while the shell 12 may be physically attached to the board. The web 14 may be electrically connected to electrical ground through a terminal on the shell 12 to which an electrical ground wire is connected.

In addition, the lightning arrestor connector 10 may be used as an inline coupler to connect two cables together, in which case the electrical contact 16 the electrical contact 16 only connects to electrical contacts 16 of other lightning arrestor connectors 10. Likewise, the shell 12 only connects to the shells 12 of other lightning arrestor connectors 10. Typically, the web 14 is electrically connected to electrical ground through a terminal on the shell 12 to which an electrical ground wire is connected.

In operation, under normal conditions, the dielectric barrier 20 may act as an electrical insulator, although charge may build up in the dielectric barrier 20 as a result of a voltage between the electrical contact 16 and the web 14. The lightning arrestor connector 10 may allow electric power or signals on the electric contact 16 to pass through the connector 10. In the event of a surge from lightning or other phenomena, the voltage between the electrical contact 16 and the web 14 may increase beyond the breakdown threshold and the dielectric barrier 20 may break down, allowing electric current to flow from the electrical contact 16 to the web 14 and electrical ground—thus preventing the surge in voltage from reaching and damaging electronic circuitry.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A dielectric barrier for use with a lightning arrestor connector, the dielectric barrier comprising:

a plurality of physically connected cells defining a hollow, tubular side wall, each cell including a frame formed from dielectric material and an aperture that creates a void within the frame, wherein the dielectric barrier is configured to be positioned between an inner conductor and an outer conductor and provides a low resistance path from one conductor to the other conductor when the voltage between the two conductors exceeds a threshold value.

2. The dielectric barrier of claim 1, wherein each cell further includes at least one post formed from dielectric material, physically connected to the frame, and extending into the aperture of the cell.

3. The lightning arrestor connector of claim 1, wherein at least a portion of the frame of one cell is physically connected to at least a portion of the frame of another cell.

4. The lightning arrestor connector of claim 1, wherein the connection of the cells forms a hollow tubular lattice with each cell having a square-shaped frame and a square-shaped aperture.

5. The lightning arrestor connector of claim 4, wherein each cell is physically connected to other cells at each corner of the frame.

6. A lightning arrestor connector comprising:

a shell including an internal cavity and opposing open ends;

a web formed from electrically conductive material and positioned in the interior of the shell, the web including a through-hole opening;

an electrical contact formed from electrically conductive material and retained within the through-hole opening, the electrical contact having a smaller diameter than that of the through-hole opening, thus forming a gap between the electrical contact and a surface of the through-hole opening which defines a breakdown chamber; and a dielectric barrier positioned in the breakdown chamber, the dielectric barrier configured to provide a low resistance path between the electrical contact and the web when the voltage between the electrical contact and the web exceeds a threshold value, the dielectric barrier constructed from a plurality of physically connected cells, each cell including a frame formed from dielectric material and an aperture that creates a void within the frame.

7. The lightning arrestor connector of claim 6, wherein each cell further includes at least one post formed from dielectric material, physically connected to the frame, and extending into the aperture of the cell.

8. The lightning arrestor connector of claim 6, wherein at least a portion of the frame of one cell is physically connected to at least a portion of the frame of another cell.

9. The lightning arrestor connector of claim 6, wherein the connection of the cells forms a hollow tubular lattice with each cell having a square-shaped frame and a square-shaped aperture.

10. The lightning arrestor connector of claim 9, wherein each cell is physically connected to other cells at each corner of the frame.

11. A lightning arrestor connector comprising:

a shell including an internal cavity and opposing open ends;

a web formed from electrically conductive material and positioned in the interior of the shell, the web including a through-hole opening;

an electrical contact formed from electrically conductive material and retained within the through-hole opening, the electrical contact having a smaller diameter than that of the through-hole opening, thus defining a gap between the electrical contact and a surface of the through-hole opening which forms a breakdown chamber; and a dielectric barrier positioned in the breakdown chamber, the dielectric barrier configured to provide a low resistance path between the electrical contact and the web when the voltage between the electrical contact and the web exceeds a threshold value, the dielectric barrier constructed from a plurality of physically connected cells defining a hollow, tubular side wall, each cell including a frame formed from dielectric material, an aperture that creates a void within the frame, and at least one post formed from dielectric material, physically connected to the frame, and extending into the aperture.

12. The lightning arrestor connector of claim 11, wherein the connection of the cells forms a hollow tubular lattice with each cell having a square-shaped frame and a square-shaped aperture.

13. The lightning arrestor connector of claim 12, wherein each cell is physically connected to other cells at each corner of the frame.

* * * * *